US006227440B1

(12) United States Patent
Hart

(10) Patent No.: US 6,227,440 B1
(45) Date of Patent: May 8, 2001

(54) PRE-LINED CARTON WITH DISPENSING SPOUT

(75) Inventor: Joseph J. Hart, Philadelphia, PA (US)

(73) Assignee: Smurfrit-Stone Container Corporation, Phoenixville, PA (US)

( * ) Notice: Subject to any disclaimer, the term of this patent is extended or adjusted under 35 U.S.C. 154(b) by 0 days.

(21) Appl. No.: 09/255,529

(22) Filed: Feb. 22, 1999

(51) Int. Cl.[7] ..... B65D 5/74

(52) U.S. Cl. ..... 229/117.3; 229/117.31; 229/125.04; 229/125.08; 229/125.15

(58) Field of Search ..... 279/117.3, 117.31, 279/117.34, 125.04, 125.08, 125.15; 222/528, 531, 535, 541.5

(56) References Cited

U.S. PATENT DOCUMENTS

| | | | | |
|---|---|---|---|---|
| 2,104,593 | | 1/1938 | Nathe, Jr. . | |
| 2,288,042 | * | 6/1942 | Spilman | 229/125.04 |
| 2,332,153 | * | 10/1943 | Levin | 222/531 |
| 2,355,313 | | 8/1944 | Lurie . | |
| 2,546,052 | | 3/1951 | Wilkins . | |
| 2,757,830 | * | 8/1956 | Hansen | 222/528 |
| 2,820,585 | | 1/1958 | Nerenberg et al. . | |
| 3,240,416 | | 3/1966 | Deegan . | |
| 3,335,922 | * | 8/1967 | Leff | 222/528 |
| 3,392,901 | | 7/1968 | Krzyzanowski . | |
| 3,426,955 | | 2/1969 | Olson . | |
| 3,952,940 | | 4/1976 | Malcolm . | |
| 4,032,060 | | 6/1977 | Bergstein . | |
| 4,154,346 | | 5/1979 | Heuberger . | |
| 4,245,743 | | 1/1981 | Heuberger . | |
| 4,266,698 | | 5/1981 | Rausing . | |
| 4,411,365 | | 10/1983 | Horikawa et al. . | |
| 4,565,315 | | 1/1986 | Wagner et al. . | |
| 4,953,781 | * | 9/1990 | Bryan | 222/531 |
| 5,857,614 | * | 1/1999 | Walsh | 229/117.31 |
| 6,062,467 | * | 5/2000 | Ours et al. | 229/117.3 |

* cited by examiner

*Primary Examiner*—Gary E. Elkins
(74) *Attorney, Agent, or Firm*—Paul M. Denk

(57) ABSTRACT

A pre-lined carton of the present invention includes a carton formed from a blank having a liner adhered to the inner surfaces of the carton. The carton includes a pour spout which is movable between a closed position and an open position. The carton has a panel which covers the pour spout and is removed to expose the pour spout. The opening created by the removable panel is sized to allow the spout to be moved from its closed position to its open position. The spout is part of a mounting assembly which includes a mounting panel to which the spout is hingedly connected. The mounting panel is glued to the inner surface of the container so that the spout will be between the mounting panel and the container wall. The spout assembly mounting panel includes an opening which communicates with the spout, and which is aligned with the removable panel of the container.

3 Claims, 4 Drawing Sheets

PRE-LINED CARTON WITH DISPENSING SPOUT

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to paperboard cartons used to hold flowable solid materials, such as liquids, grains, cereals, flour, etc., and, in particular, to a such a carton which is per-lined and includes a pouring spout.

Currently, many products, such as breakfast cereals and grains, are sold in paperboard boxes. Sometimes the product is simply held directly in the box. That is, there is no lining on the inner surface of the box. Other times, as is often with products such as breakfast cereals, the product is contained within a wax bag inside of the paperboard carton. When a wax bag is used, the wax bag, generally, is formed and filled with the product. Then the paperboard box or carton is formed around the filled wax bag. Lined cartons can be made more efficiently.

Further, such cartons could be provided with a spout to make pouring of the product easier. In the cartons which do have spouts (i.e., boxes of rice or other grains), the spout is simply a hole defined by perforations in the carton, either on the top of the carton, or at the top of a side wall of the carton. Such spouts are often difficult to open and result in a cardboard panel extending into the carton. Further, this cardboard panel often interferes with pouring or the product from the box.

BRIEF SUMMARY OF THE INVENTION

A pre-lined carton of the present invention includes a carton formed from a blank having a liner adhered to the inner surfaces of the carton. The carton includes a pour spout which is movable between a closed position and an open position. The carton has a panel which covers the pour spout and is removed to expose the pour spout. The opening created by the removable panel is sized to allow the spout to be moved from its closed position to its open position.

The spout is part of a mounting assembly which includes a mounting panel to which the spout is hingedly connected. The mounting panel is glued to the inner surface of the container so that the spout will be between the mounting panel and the container wall. The spout assembly mounting panel includes an opening which communicates with the spout, and which is aligned with the removable panel of the container.

The liner is glued to a surface of the pour spout. The liner is etched to create an area of weakness where the liner is glued to the spout. The spout is initially closed to prevent access to product within the liner. However, upon opening the spout for a first time, an opening forms in the liner to allow the product to be poured out of the carton. This enables the container to be shipped with product in it and with the liner in a fully closed condition.

The pre-lined carton is formed by (1) providing a tube of a desired size; (2) closing one end of the tube to define a pouch; (3) providing a carton blank; (4) applying glue to an inner surface of the carton blank; (5) setting the pouch on the carton blank to glue the pouch to the carton blank; and (6) folding the carton around the pouch. Preferably, the carton is compressed after it is folded around the pouch or liner to ensure that the liner is glued to all the side wall surfaces of the container. The spout assembly is formed and glued to the carton blank prior to applying the liner to the carton blank. A portion of the liner or pouch is etched, as noted above, to create an easily openable portion of the liner. This portion of the liner is glued to an inner surface of the spout.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe to be the best mode of carrying out the invention.

Figure 1:
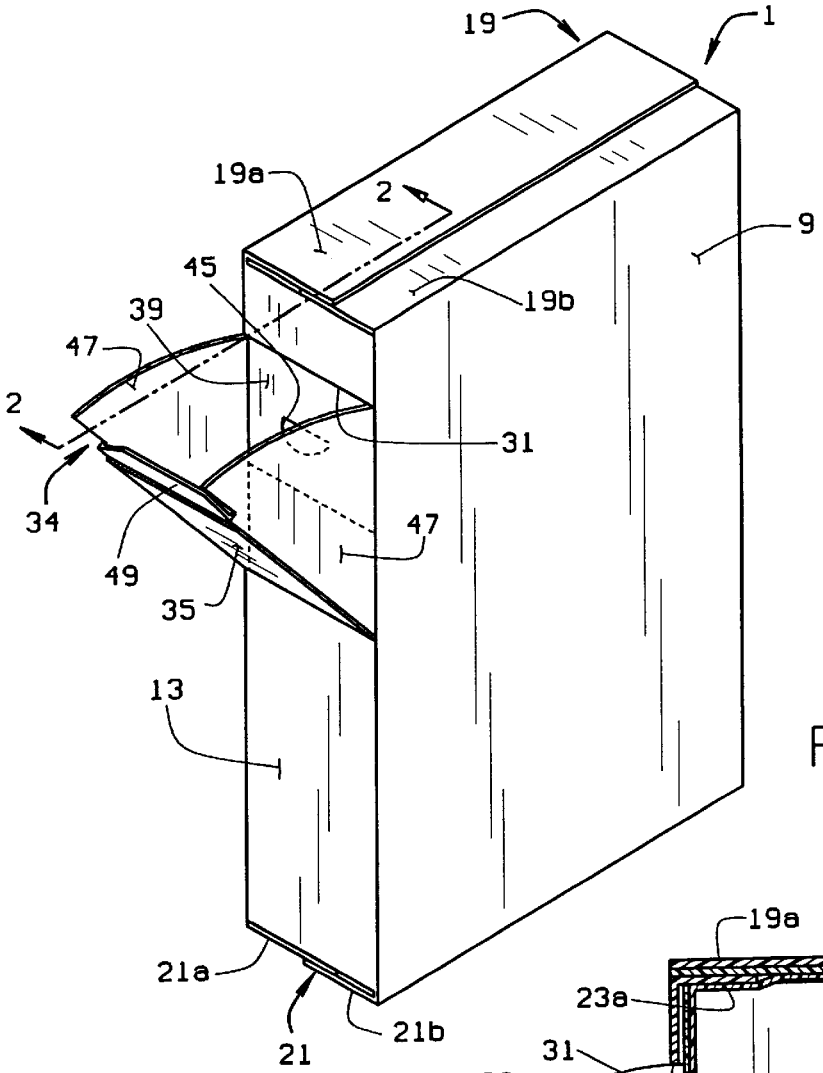
FIG. 1 is a perspective view of a carton of the present invention with the spout opened.
Figure 2:
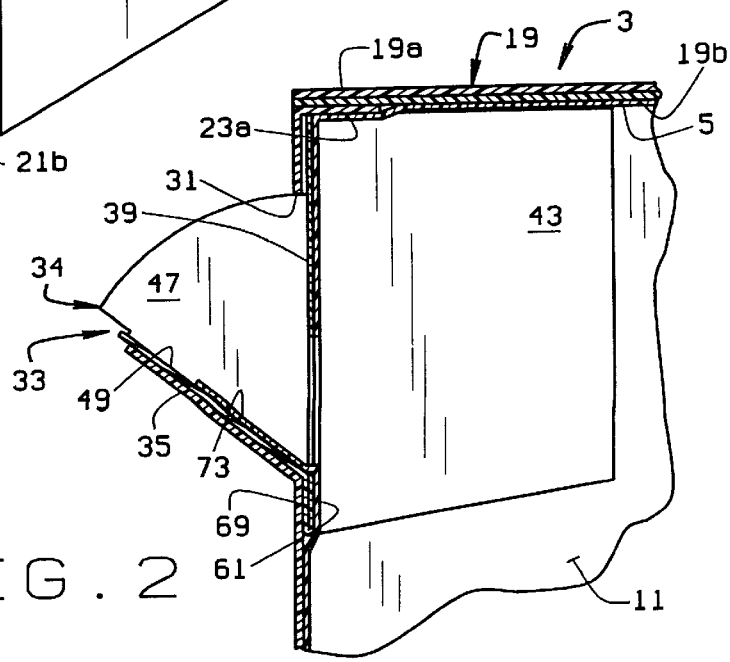
FIG. 2 is a cross-sectional view of the carton taken along line 2—2 of FIG. 1.
Figure 3:
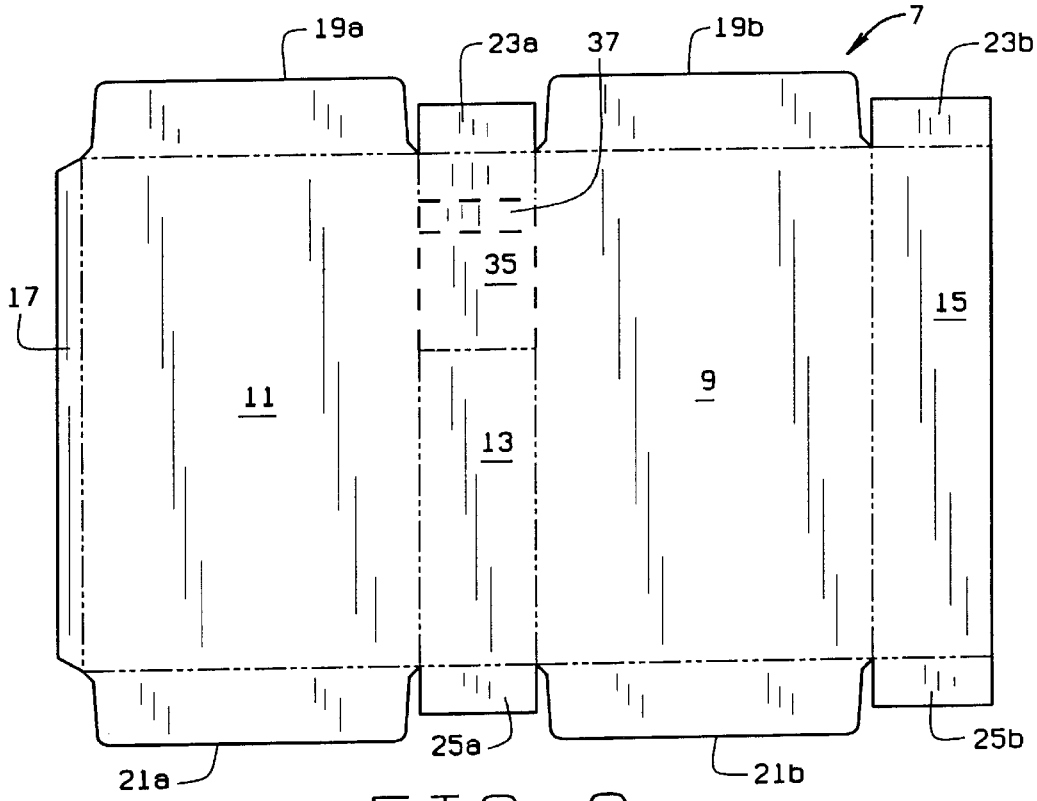
FIG. 3 is a plan view of a blank used to form the carton.

A carton 1 of the present invention is shown generally in FIGS. 1 and 2. The carton 1 includes a container 3 having a lining 5. The container 3 is preferably a cardboard or fiberboard container which is made from a blank 7, shown in FIG. 3. The container 3 is shown in the form of a box, having a front wall 9, a back wall 11, a first side wall 13, and a second side wall 15. The side wall 15 is glued to the back wall 11 by a glue tab 17. The four walls are hingedly connected together along fold lines, as seen in FIG. 3. The container 3 also includes a top 19 and a bottom 21 which are formed by top and bottom members 19*a,b* and 21*a,b*. The container 3 also includes top and bottom side tabs 23*a,b*, and 25*a,b*.

An opening 31 is formed in the first side wall 13 to accommodate a spout assembly 33 having a spout 34. The opening 31 is initially closed by a panel 35 which is perforated along its sides and top, so that the panel 35 may be folded down relative to the container 3 (as seen in FIGS. 1 and 2), or removed from the container 3. A tear strip 37 is provided above the panel 35 to facilitate folding of the panel. Upon opening of the panel 35, the spout assembly 33 is exposed. The spout may be moved between a closed position in which the container opening 31 is closed to prevent product from within the carton 1 from escaping the carton and an open position (shown in the drawings) in which the product within the carton can be poured from the carton. Preferably, the carton is provided to the ultimate customer with the panel 35 in place for the end user or consumer to remove.

Figure 4:
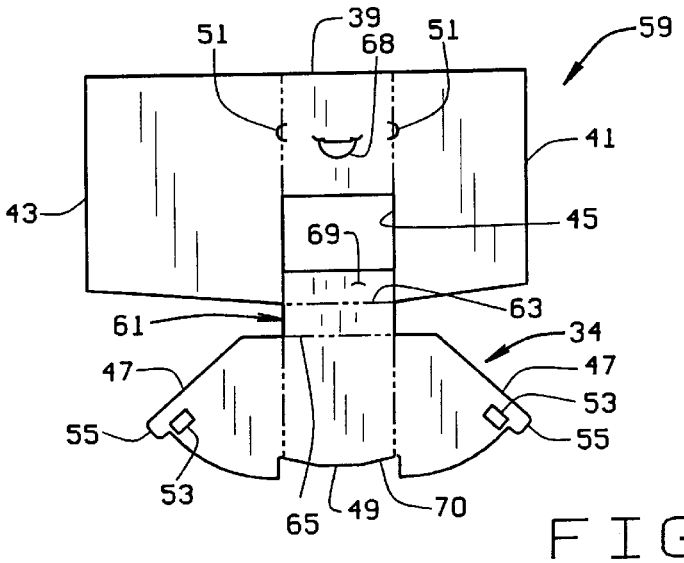
FIG. 4 is a plan view of a blank used to form the carton spout.
Figure 5:
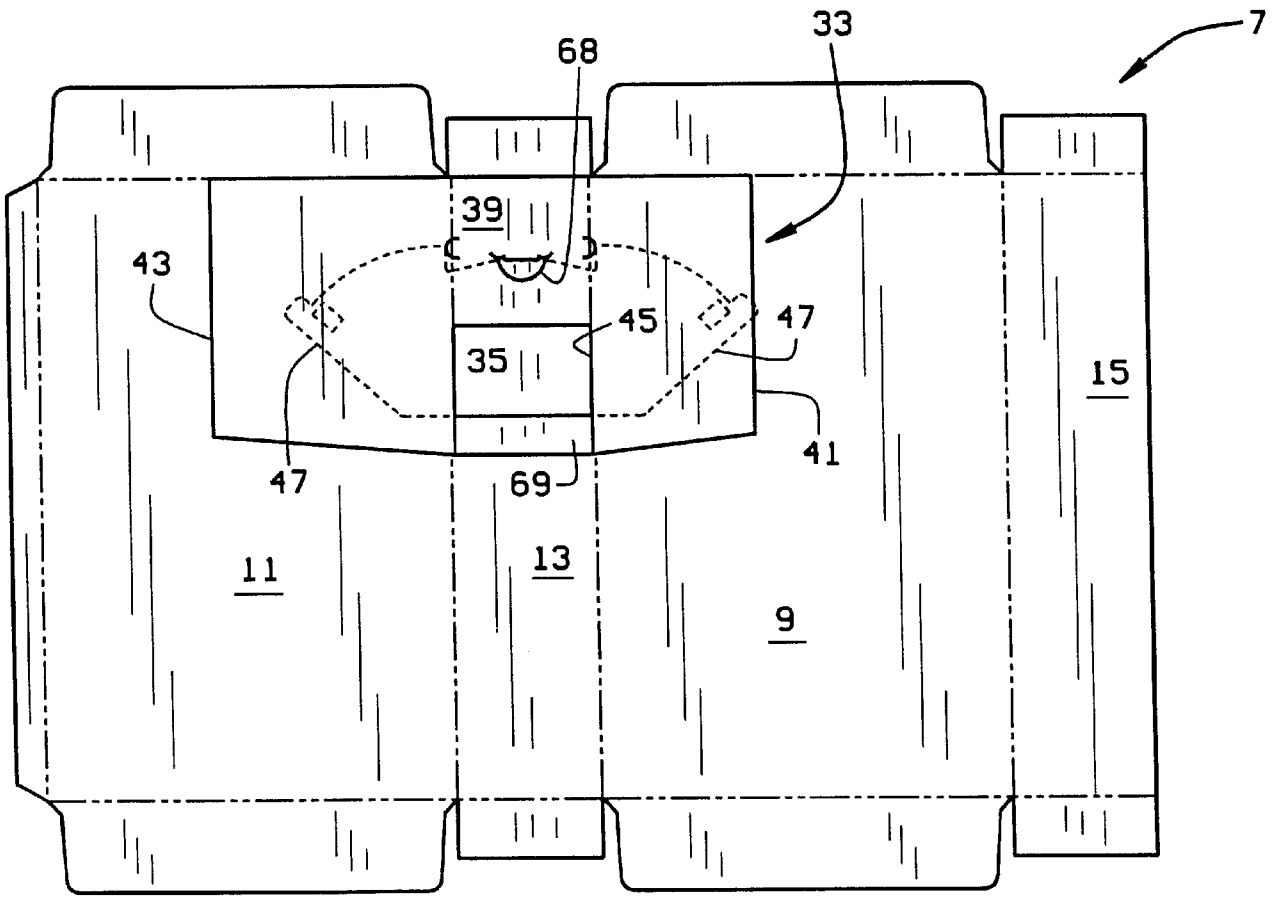
FIG. 5 is a plan view of the carton blank with the spout blank glued in place.

Turning to FIGS. 4 and 5, the spout assembly 33 includes mounting plate 39 and wings 41 and 43 which are adhered to the inner surfaces of the carton side 13 and front and back walls 9 and 11. Preferably, the mounting plate 39 has a side-to-side width approximately equal to the side—side width of the inner surface of the first side wall 13. As shown, the wing 43 is larger than the wing 41. However, the wings 41 and 43 could be of the same size, if desired. The wings are also generally trapezoidal in shape. The mounting plate 39 includes an opening 45 which communicates with the interior of the carton to allow product to be poured from the carton. The spout 34 is hingedly connected to the plate 39 and includes a pair of side walls 47 and a front wall 49 which extends between the side walls 47. The spout side walls 47 preferably have an arcuate upper edge. The spout 34 preferably has a width slightly less than the side—side width of the container side 13. The spout assembly also includes a pair of projections 51 which extend from the side edges of the mounting plate 39 and openings 53 in the spout side walls 47. The plate projections 51 and the spout side wall openings 53 are positioned so that when the spout 34 is opened to its full amount, the projections 51 will engage the openings 53, to prevent the spout 34 from being pulled out of the container 3. Additionally, the spout 33 includes fingers 55 which extend from the top edge of the spout side walls 47 near the side edges of the side walls 47. The fingers 55 will contact the inner surface of the container side wall 13 to also help prevent the spout 34 from being pulled out of the container 3.

The spout assembly 33 is made from a paper board blank 59. As seen in FIG. 4, preferably, the spout 34 is not connected directly to the mounting plate 39. Rather, there is a neck 61 between the mounting plate 39 and the spout 34. The neck is hingedly connected to the mounting plate 39 along a fold line 63, and the spout 34 is hingedly connected to the neck by a fold line 65. The neck has a top-to-bottom length approximately equal to the portion 69 of the mounting plate 39 below the opening 45. The neck 61 is folded about its fold line 63 and glued to the mounting plate portion 69. Thus, the spout 34 will pivot about its fold line 65 and the bottom of the spout will be substantially flush with the bottom of the opening 45. As can be appreciated, when the spout 34 is mounted to the container 3, as seen in FIG. 5, the spout side walls 47 will be sandwiched between the spout assembly wings 41 and 43 and the container side walls 9 and 11. The spout side walls will thus slide in the space between the spout assembly wings 41 and 43 and the container side walls 9 and 11.

The spout assembly includes a tongue 68 above the opening 45. The tongue 68 engages the top edge 70 of the spout front panel 49 to hold that spout in its closed position. As seen in FIG. 4, preferably, the spout panel top edge 70 is below the top curved edge of the spout side walls 47.

The liner 5 is formed from a flexible bag 71 which contains the product housed by the container. As discussed below, the bag 71 is glued or otherwise adhered to the inner surfaces of the container 3 during the formation of the carton 1. The bag 71 includes an etched section 73 which is glued to the inner surface of the spout front wall 49. The bag is fully sealed after being filled. When the spout 34 is opened for the first time, the spout front wall 49 will pull with it the etched area 73 of the bag 71 to open the bag 71, so that the product within the bag 71 may be poured from the carton 1.

Figure 6:
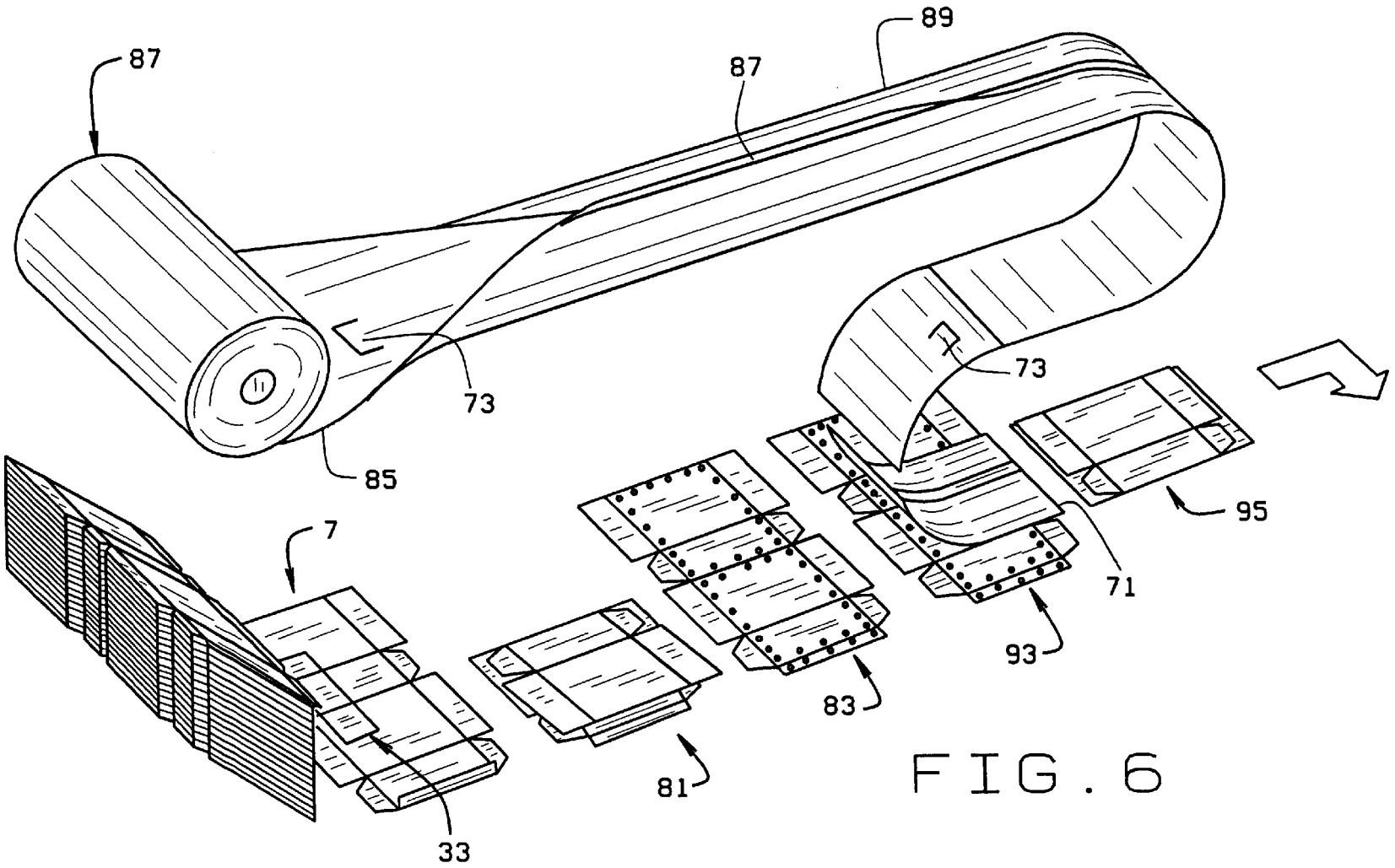
FIG. 6. is a schematic diagram showing the formation of pre-lined cartons of the present invention.

The process for making the carton 1 is shown in FIG. 6. Initially, a spout assembly blank is withdrawn from a bank of spout assembly blanks. The spout assembly blank is folded along fold line 63 and the neck 61 is then glued to the mounting plate portion 69. In a parallel operation, a container blank 7 is drawn from a bank of container blanks. The folded spout assembly 33 is then glued into place on the inner surface of the container blank 7 with the spout 34 between the mounting wall 39 and the container blank 7, as seen in FIG. 5. Preferably, only the mounting plate 39 of the spout assembly is glued to the container blank. Once this has been completed, the container blank 7 is prefolded, as at station 81. The blank is then opened, and glue is applied to the periphery of the container walls 9, 11, 13, and 15, as at station 83. In another parallel operation, webbing 85 is pulled from a roll 87 of the webbing 85. The webbing 85 is rolled over and butt welded, as at station 87 to form a long tube 89. Additionally, the webbing is etched at desired increments to form the etched area 73 of the liner 5. The tube 89 is then cut into desired lengths, and closed along the bottom of the tube to form the bag 71. The bag 71 is then placed over the container blank, as at station 93, so that the etched portion 73 will be aligned with the spout assembly opening 35. The bag 71 is then pressed into place to be glued to the container. The container blank is then folded around the bag 71, as at station 95, and compressed, to ensure that the bag is glued to the walls 9, 11, 13, and 15 of the container 3. The container is then shipped in this flattened state to a customer. The customer, using carton forming equipment, rights the container 3 and forms the bottom 21 of the container. When the container 3 is thus formed, the top of the bag 71 will be opened, and the bag can be filled with a desired product. After filling, the top of the bag 71 is sealed, and the container top 19 is formed. The filled pre-lined carton 1 is then ready for shipping to be purchased by the end consumer.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

What is claimed is:

1. A pre-lined carton including:

a carton box formed from a blank, the carton comprising walls which define an enclosure, the carton walls having inner surfaces;

a liner sized to fit in the carton enclosure, said liner being glued to the inner surfaces of the carton walls;

a pour spout on the carton, the pour spout being movable between a closed position and an open position, the liner also being glued to a surface of the pour spout, whereby the spout is initially closed to prevent access to product within the liner, and upon opening the spout for a first time, an opening forms in the liner to allow the product to be poured out of the pour spout of the carton;

said liner being adhered to the inner surfaces of the carton in the blank configuration before the blank is folded into the carton box;

a spout assembly, the spout assembly including a mounting panel and said pour spout, said mounting panel being adhered to said inner surface of one of said carton walls, said pour spout being hingedly connected to said mounting panel, said pour spout being positioned between said mounting panel and said carton wall, said mounting panel including an opening therein sized to permit product to flow from said liner through said pour spout after said pour spout has been opened for the first time.

2. The pre-lined carton of claim 1 including a removable panel on said carton wall; said spout assembly being positioned in said carton wall such that said mounting panel opening is aligned with said carton removable panel; whereby when said panel is removed from said carton an opening is formed in said carton wall which exposes said pour spout; said carton wall opening being sized to permit said pour spout to pivot through said carton wall opening.

3. The pre-lined carton of claim 1 including said removable panel having edges, and a tear-strip adjacent an edge of said removable panel to facilitate removal of said removable panel.

* * * * *

UNITED STATES PATENT AND TRADEMARK OFFICE

CERTIFICATE OF CORRECTION

PATENT NO. : 6,227,440 B1
DATED : May 8, 2001
INVENTOR(S) : Hart, Joseph J.

It is certified that error appears in the above-identified patent and that said Letters Patent is hereby corrected as shown below:

Column 6,
Line 14, please change "1" to as follows -- 2 --

Signed and Sealed this

Fourteenth Day of May, 2002

*Attest:*

*Attesting Officer*

JAMES E. ROGAN
*Director of the United States Patent and Trademark Office*